United States Patent [19]

Peterson

[11] Patent Number: 5,046,928

[45] Date of Patent: Sep. 10, 1991

[54] LONG TERM COMPRESSOR CONTROL APPARATUS

[75] Inventor: Clyde O. Peterson, Plum Borough, Pa.

[73] Assignee: Westingshouse Electric Corp., Pittsburgh, Pa.

[21] Appl. No.: 457,046

[22] Filed: Dec. 26, 1989

[51] Int. Cl.[5] ..... F04B 49/08

[52] U.S. Cl. ..... 417/282; 417/289; 417/290; 417/295; 417/307

[58] Field of Search ..... 417/282, 289, 290, 295, 417/300, 307, 310

[56] References Cited

U.S. PATENT DOCUMENTS

| | | | |
|---|---|---|---|
| 3,380,650 | 4/1968 | Drummond et al. . | |
| 3,535,053 | 10/1970 | Jednacz . | |
| 3,574,474 | 4/1971 | Lukacs | 417/307 |
| 3,594,093 | 7/1971 | Lukacs | 417/307 |
| 3,778,695 | 12/1973 | Bauer, Jr. . | |
| 3,863,110 | 1/1975 | Bauer, Jr. . | |
| 4,080,110 | 3/1978 | Szymaszek . | |
| 4,191,511 | 3/1980 | Stewart et al. . | |
| 4,462,217 | 7/1984 | Fehr . | |
| 4,519,748 | 5/1985 | Murphy et al. . | |

*Primary Examiner*—Leonard E. Smith
*Assistant Examiner*—David W. Scheuermann
*Attorney, Agent, or Firm*—C. M. Lorin

[57] ABSTRACT

In a compressor control system, a subcontroller is coupled with the master-controller in order to detect, when the bypass valve is being modulated, whether there is a deviation between the minimum inlet valve position assigned to the system and the actual inlet valve position. In such case, correction of the inlet valve position is automatically effected by the subcontroller in either direction to restore the minimum assigned inlet valve position.

3 Claims, 4 Drawing Sheets

LONG TERM COMPRESSOR CONTROL APPARATUS

FIELD OF THE TECHNIQUE

The invention relates to compressor control in general, and more particularly to compressor control operative on a long term while preventing the occurrence of a surge due to drift in the mechanical linkage of the inlet valve of the compressor.

BACKGROUND OF THE INVENTION

It is known to maintain the flow of fluid in a compressor above a minimum flow level, and a controller has been associated with the compressor control system imposing a control setpoint to this effect. As shown in U.S. Pat. No. 3,380,650, the inlet valve is controlled downward only to a minimum positioning level, in order to avoid a nonsteady situation which would cause a surge. This limit has been called the surge point. It is also known from this same patent to recognize such minimum positioning of the inlet valve by sensing a minimum horse power from the motor driving the compressor. Such minimum positioning, however, is not maintained by the system over the long term. It is now proposed, when controlling the bypass valve, to automatically maintain the inlet valve at its minimum position, while using the current of the motor driving the compressor as an indicator.

In this regard, it is known from U.S. Pat. No. 3,535,053 to use the current in the motor driving a compressor for establishing a limit overriding any normal further adjustment of the vane of the compressor. From U.S. Pat. No. 4,080,110, it is known to regulate compressor capacity in relation to the current in the motor driving the compressor, so as to maintain a predetermined motor input current. U.S. Pat. No. 4,519,748 shows control of the slide valve of a helical screw type compressor while continuously seeking the position at which the compressor drive motor current is at a minimum U.S. Pat. No. 4,462,217 discloses, upon changes in the dynamic pressure of a propulsion system driven by an electric motor, how a constant flow of fluid is maintained.

U.S. Pat. No. 3,778,695 discloses the use of a minimum value of the current of the motor driving a compressor as a limit for transferring control of the inlet valve to control of the bypass valve of the compressor.

A surge is known to occur in a centrifugal compressor when the back pressure of the load becomes greater than the compressor pressure. It is known to prevent such occurrence by using a blow-off, or bypass valve, to vent the compressor when the flow falls below a preset minimum. See for instance U.S. Pat. No. 3,863,110.

It is acknowledged as known in U.S. Pat. No. 4,191,511 to operate a compressor at a preselected constant speed with the output being regulated over a relatively narrow range to provide compressed gas to a process at a rate sufficient to provide the maximum needed compressed gas while using a vent, or relief valve for increased range of operation.

While it is recognized that for continuous operation a minimum flow rate should at all time be maintained in order for the compressor to be ready to supply the new demand following a fall of the demand, such minimum flow rate cannot be relied upon without attending to its determination from time to time. The object of the present invention is to provide a reliable minimum flow rate at all times without impeding readiness for further processing nor the establishing of a steady state at low ebb pending the return of the normal demand. Such an approach insures long term and continuous operation of a compressor system under extreme load demands without any risk of a surge.

SUMMARY OF THE INVENTION

The invention relates to a compressor system for controlling the inlet valve and the bypass valve of the compressor; the compressor being driven by a constant speed electrical motor for supplying a constant flow of fluid to a load having an instantaneous operative pressure thereunder; and a master-controller being provided for modulating the inlet and bypass valves, one at a time, in response to such load pressure for readjusting the same. The compressor system is assigned a minimum inlet valve position insuring a minimum airflow at the time the bypass valve is taking over upon a requirement for a decreased load demand. According to the invention, whenever the bypass valve is operating to decrease the tank pressure, after the inlet valve under master-controller inlet valve modulation has reached its minimum position (whereby tank pressure adjustment is to be pursued further by modulating the bypass valve) a series steps to corrective adjust the inlet valve position are established whenever a deviation from the minimum inlet valve position has thereafter been detected. The occurrence of the inlet valve minimum position is detected by comparing the current of the motor driving the compressor to a minimum current magnitude representative signal and this is used to know whether thereafter deviations occurred. Inlet valve minimum position adjustments are asynchronously, or cyclically, performed independently of the bypass modulation, in either direction in response to the detected deviation.

DESCRIPTION OF THE PREFERRED EMBODIMENT OF THE INVENTION

Figure 1:
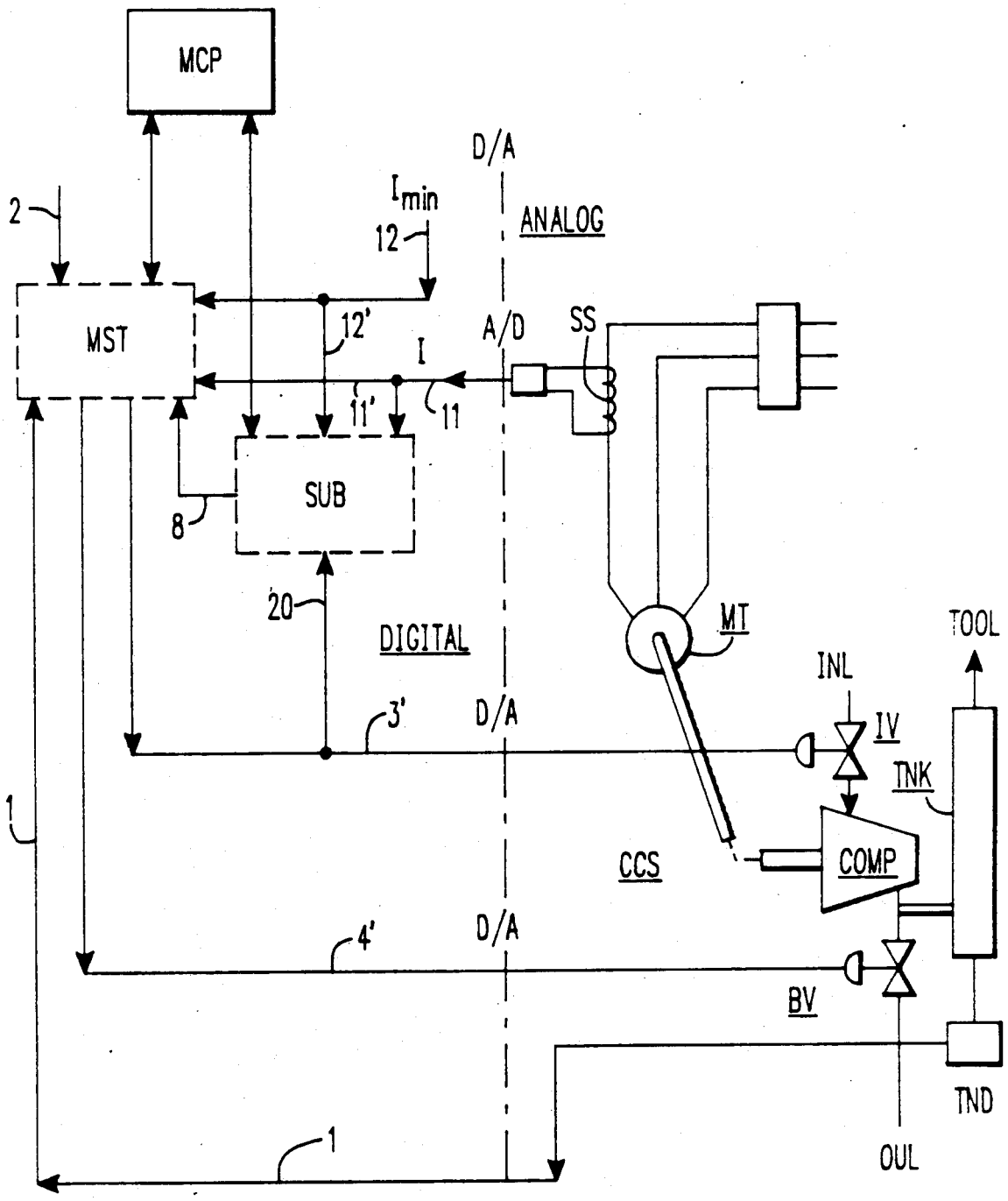
FIG. 1 is an overview in block diagram of the compressor control system according to the invention.

Referring to FIG. 1, the compressor control system CCS according to the invention is shown controlling, via lines 3' and 4', the inlet and the outlet valves (IV and BV) of a compressor COMP driven at constant speed by an electric motor MT. The current I of the motor is sensed by a current sensing circuit SS to derive a current signal on line 11 which is to be compared within the master-controller MST, as explained hereinafter, with a predetermined minimum Imin applied as a reference on line 12. Line 11 is fed into an analog-to-digital converter at the interface of the compressor control system CCS. The master-controller is monitored and controlled by a microprocessor (typically, an INTEL 8031) MCP communicating bidirectionally with it. The value of Imin may be provided as data by the microprocessor MCP. Air flow through the compressor is admitted from an inlet INL through the inlet valve IV.

At the outlet the compressor delivers through a check valve (not shown) air to maintain an operative pressure p within a tank TNK used by a tool. From the tank, a signal indicative of the pressure tank p is derived with a transducer (TND), then, applied to the master-controller, by line 1, through the analog-to-digital interface of the compressor control system CCS. Line 2 provides a reference signal representing the pressure setpoint corresponding to the minimum airflow in the tank. The master-controller responds to the signals of lines 1, 2, 11 and 12 and generates control signals on lines 3' and 4', through the digital-to-analog interface. The inlet and bypass valves (IV and BV) are respectively controlled by lines 3 and 4, with a delay (DL1 and DL2, respectively) before reaching lines 3' and 4'. This delay accounts for the cyclical operation of the microprocessor establishing a delay between each successive control steps. Typically, this delay is of the order of 100 milliseconds. Accordingly, the control value before the delay block (DL1, or DL2) may be considered as the "next" value, whereas the one existing after the delay block may be regarded as the "old" value. When the tool operates, airflow through the inlet valve ("inlet valve modulation") is constantly adjusted by the master-controller in order to match the airflow withdrawn by the tool, thereby maintaining an adequate pressure in the tank in accordance with the pressure setpoint imposed to the master-controller. The preceding is the "normal operative mode" of the compressor. Should the tool cease to demand airflow, the pressure in the tank will increase under the coming flow from the inlet valve, and the master-controller will react to the so created error between the signals of lines 1 and 2, so as to command by line 3' a progressive closing of the inlet valve. However, a minimum airflow is required through the compressor in order to avoid a surge. Therefore, when such minimum flow has been reached by positioning the inlet valve IV to a minimum position P2, further adjustment of the loading of the tank behind the check valve is achieved by controlling the bypass valve BV, thereby to exhaust any excess of air, into the atmosphere. This is the "bypass valve modulation mode". The present invention pertains to reaching with the master-controller the inlet valve position P2 for said minimum airflow through the compressor, and maintaining it thereafter at all times, while controlling the bypass valve BV. This is achieved by the compressor control system CCS through the combined effect of the master-controller MST and of a subcontroller SUB which comes under monitoring and control of the microprocessor MCP and of a timer TMR, as explained hereinafter. The subcontroller SUB is responsive to the lines 11' and 12' which are derived from lines 11 and 12, and also to the present inlet valve position derived from line 3', by line 20, after the delay block DL1. As a result, during bypass modulation by the master-controller via line 4', the subcontroller SUB applies intermittently an incremental corrective value onto line 8, which the master-controller applies in turn by correcting the input of line 3 into the delay DL1.

Figure 2:
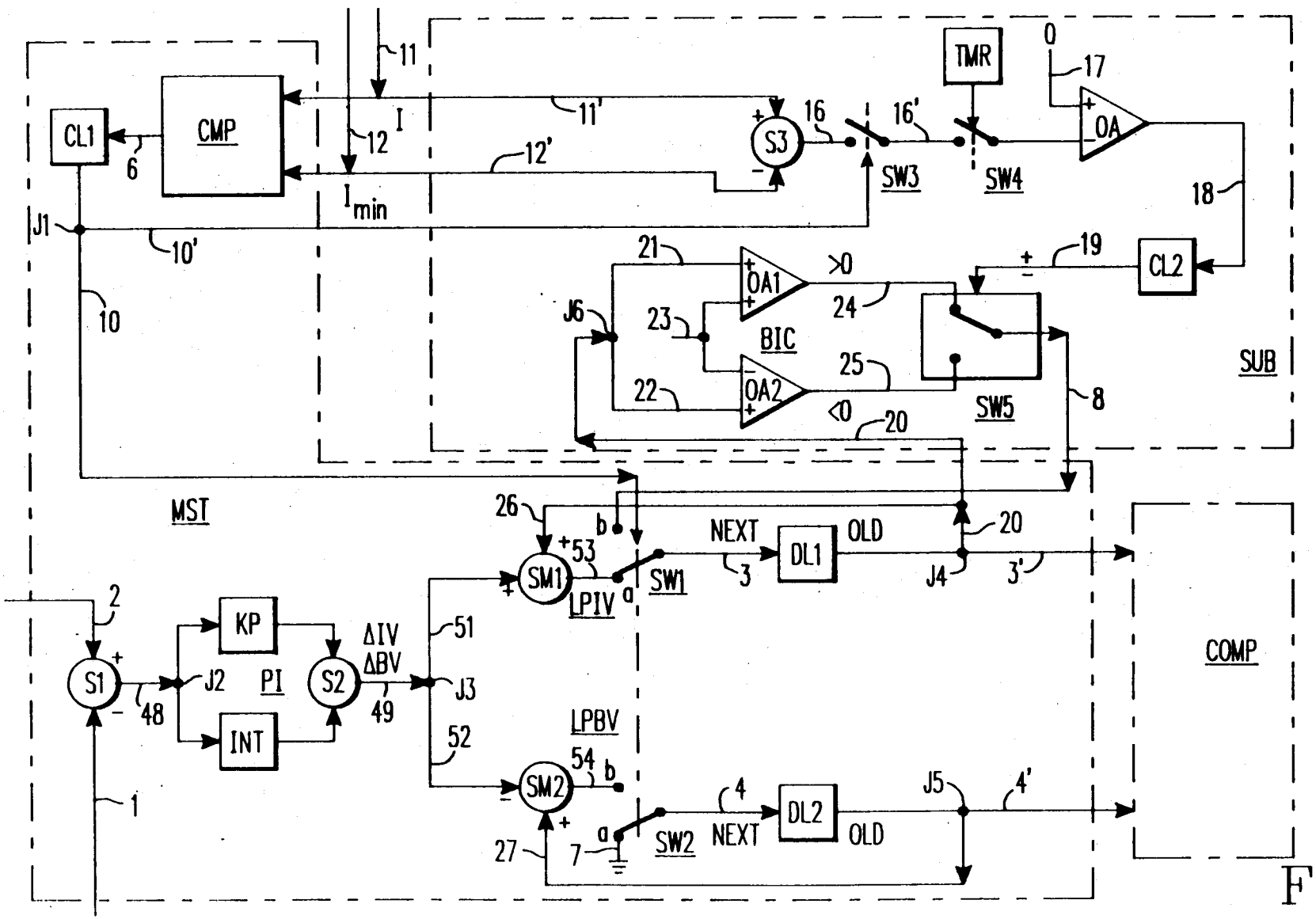
FIG. 2 illustrates the preferred embodiment of the compressor control system according to the invention.

Referring to FIG. 2 which represents the preferred embodiment of the invention, the master-controller MST and the sub-controller SUB, which are part of the compressor control system of FIG. 1, are specifically shown in block diagram. The master-controller MST responds to the pressure feedback signal derived on line 1 from the tank, as established at the outlet of compressor COMP, and to the pressure setpoint applied on line 2. The master-controller is used to establish a valve position either for the inlet valve IV, or for the bypass valve BV of the compressor. As generally known, when a compressor is working into a low demand, the pressure of line 1 will increase substantially, and the master-controller will react by line 3' to progressively close the inlet valve (IV). However, when a position P2 has been reached corresponding to a minimum air flow through the compressor, further control will be effected by modulating via line 4' the bypass valve (BV). To this effect, the master-controller includes a subtractor S1 responsive to the pressure feedback signal of line 1 and to the pressure setpoint signal of line 2, so as to derive an error which, as generally known, is used from line 48 by two parallel loops from junction J2: a proportional loop illustrated by block KP and an integrator loop illustrated by block INT, their respective outputted command signals being summed up by a summer S2 and providing on junction J3 an error signal ΔIV if under IV modulation, ΔBV if under BV modulation. In the first instance (switch SW1 in its position as shown), from junction J3 the error signal ΔIV goes to a summer SM1 to be added to the "old" value of the IV position received, from junction J4 of line 3', by lines 20 and line 26. Within the inlet valve modulation loop LPIV, summer SM1 adds up the old value IV and the error ΔIV from line 49, thereby generating a "next" value on line 3 for repositioning of the inlet valve. This is due to the fact that switch SW1 joins line 53 from SM1 to line 3 when under inlet valve modulation and in position a, as shown in FIG. 2. Similarly, within the bypass valve modulation loop LPBV, from junction J3 the error ΔBV goes by line 52 to a summer SM2 where it is subtracted from the "old" value of the bypass valve position as received from junction J5 on line 4' via line 27. Therefore, on line 54 appears the new value (BV+ΔBV) which is passed onto line 4 by switch SW2 (if in position b and under bypass valve modulation). In other words, under inlet valve modulation the error on line 49 will adjust the inlet valve, whereas under bypass valve modulation it will adjust the bypass valve. Whether there is inlet valve, or bypass valve modulation, will depend upon whether the inlet valve has reached the minimum allowed position P2. This is detected by a comparator CMP responsive to the difference between the instant motor current I (applied on line 11) and the minimum motor current Imin (used as a reference) on line 12 thereto. The motor current is proportional to the inlet valve position, assuming a motor running at constant speed for constant flow through the compressor. Therefore, P2 is reached when the current has decreased to Imin on line 11. As a result, coil CL1 will be energized, via line 6, causing by line 10 switches SW1 and SW2 to transfer from position a to position b. On the one hand, switch SW1 is no longer passing commands from line 53 to line 3, and instead it rests upon line 8 as its new input. On the other hand, switch SW2 (which in position a was at rest on line 7 at ground potential, namely with zero input, i.e. BV in the closed position) is now connected to line 54 and receives the output from summer SM2.

Should the tool be stopped and the process be interrupted, the compressor is relieved from supplying airflow at full capacity when line 3' causes closing of IV. Comparator CMP is responding to the error between line 11 and line 12. Once valve IV reaches a position for which I becomes equal to Imin, comparator CMP triggers coil CL1 to generate, on line 10, a command to switch SW1 and SW2 from their positions a to positions b. Valve IV should, then, be and remain at a position P2 corresponding to minimum airflow. When a compressor is working into a relatively small pressure demand, the inlet valve IV will be placed at the P2 position, as selected for to give the assigned minimum motor current, and pressure control will be pursued through modulating the bypass valve BV. Nevertheless, over a long time the mechanical and hydraulic linkages, due for instance to hydraulic fluid leaks, will loose their integrity, and the inlet valve will wander from its P2 position, the motor current decreasing below the operated requested minimum setting Imin. Under these conditions, a sudden change of pressure demand may cause a surge. It is the operator concern that the low limit P2 be maintained by the master-controller. The master-controller controls only one valve at a time, IV or BV. It is observed that the physical valve position is in an open loop with the controller. This means that the controller only commands the valve to be at a position, without monitoring the effective actual position thus, not determining whether, or not, the valve has obeyed the command. Therefore, it is important to know whether the inlet valve which has been used to relieve the airflow from full capacity, is actually maintaining minimum airflow, while modulation of the bypass valve is taking place. This function is performed by a subcontroller SUB associated with the master-controller and coming into the picture through a switch SW3 controlled by coil CL1 and line 10' at the same time as switches SW1 and SW2 are being switched by line 10.

As shown in FIG. 2, the subcontroller SUB receives from line 20 the old value IV derived from junction J4 of line 3', and contains a bidirectional circuit BIC which as long as there is a deviation will (via OA1) add to it, or (via OA2) subtract from it, a fixed predetermined delta value applied on line 23, so that the input on line 8 position b of switch SW1 be increased, or decreased, thereby maintaining the value of the old IV at P2. The deviation is detected by a comparator S3 responsive to lines 11' (for motor current I) and 12 (for Imin). The error on line 16 is passed by switch SW3 onto line 16' if the switch is closed, namely if lines 10 and 10' from coil CL1 indicate that position P2 has been reached under inlet valve modulation and that the SUB has been activated by switch SW3. Another switch SW4 is actuated by a timer TMR so that it closes periodically, typically every half-second. Thus, timer TMR establishes a regular timing for checking whether line 16 from summer S3 indicates a deviation from position P2. The deviation signal of line 16' is applied over switch SW4, when closed, onto one input of a subtractor OA which at a second input receives a reference Zero. Accordingly, the output line 18 thereof will be either indicative of a positive error, or of a negative error. A coil CL2 will respond to line 18 by placing by line 19 a switch SW5 into one position, or the other, depending on the sign of line 18. The BIC circuit has two loops. One, for negative error and incrementing action, includes a summer OA1 responsive on one input to line 20 and junction J6 to which the other input, by line 23, adds delta values. The resulting increased value of the IV value of junction J4 becomes the next control value for IV. The other loop, for positive error and decrementing action, includes a summer OA2 responsive on one input to line 20 and junction J6 to which another input, by line 23, subtracts delta values. The resulting decreased value of junction J4 becomes the next control value for IV. In either case, the corrected value will appear on line 8. In other words, the last value for P2, passed on line 3' and line 20, will be modified by circuit BIC and appear as corrected on lines 8 and 3, each time timer TMR will have tested the situation by closing switch SW4.

FIGS. 1 and 2 show the invention in block diagram. It is understood, however, that by computer treatment all the steps of control by comparator CMP, subtractors S1, S2, S3, coils CL1, CL2, switches SW1 to SW5, are accomplished by digital treatment of data passed to and from the system in both directions by the microprocessor MCP. The generation of delta values as increments by the BIC circuit is also, as generally known, done digitally. For instance, a 8-digit number is cyclically generated by a digital counter from 0 to 9. Upon each digit count, there will be a fraction added, or subtracted, from an inlet valve IV having a range of 4 ma to 20 ma between fully closed and fully opened.

Figure 3:
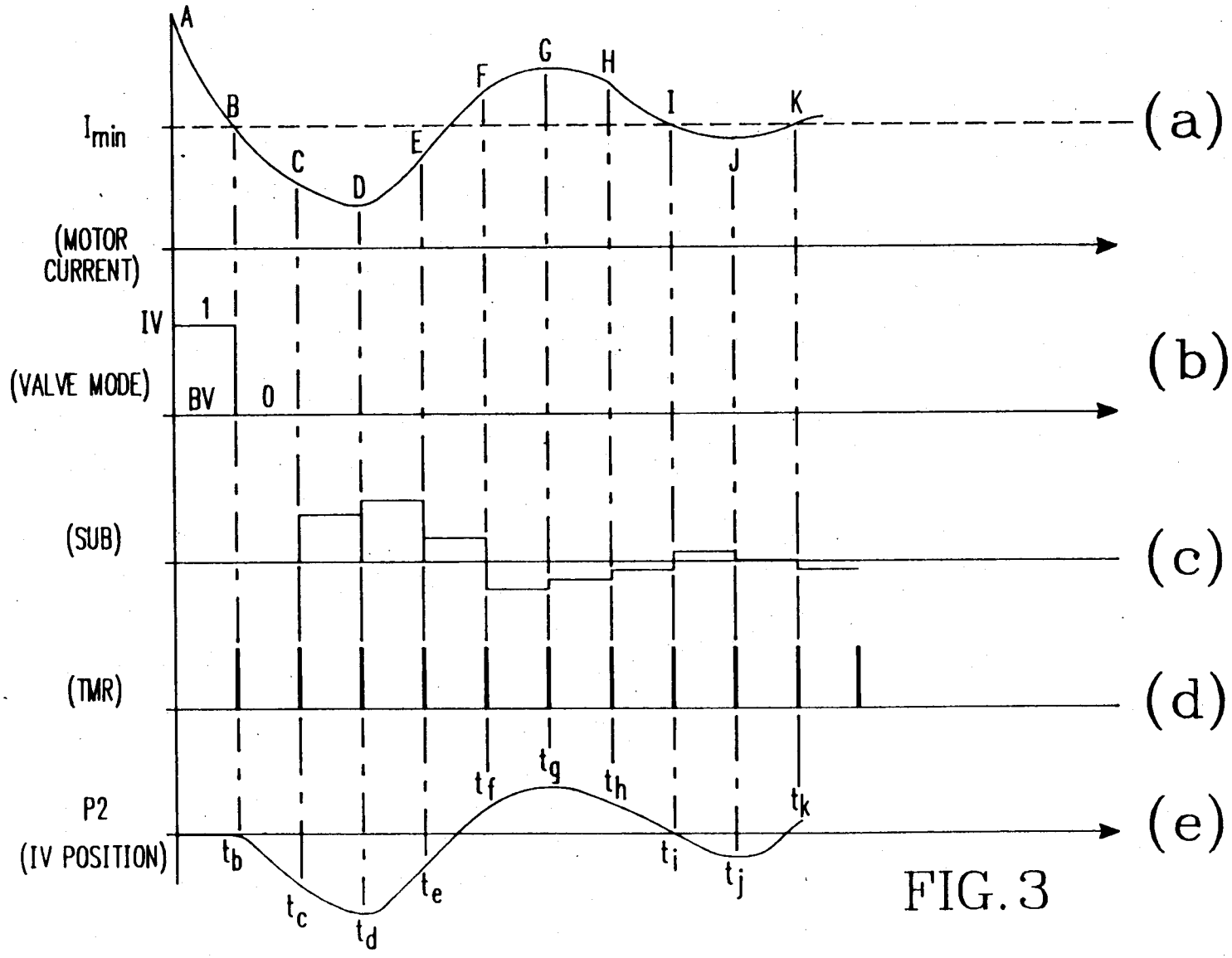
FIG. 3 shows curves illustrating the operation of the subcontroller which is part of the compressor control system of FIG. 1 and FIG. 2.

FIG. 3 shows with curves the operation of the system of FIG. 2. Curve (a) gives the values as a function of time of the sensed motor current I, coming down from above at A, then reaching at instant tb the level Imin assigned to it for a P2 position of IV. At that moment, as shown by curve (b), the system passes from the IV mode to the BV mode. Switches SW1, SW2 are being shifted from position to position b and switch SW3 (enabling the subcontroller SUB) is being closed when coil CL1 is energized by line 7 from comparator CMP. In the BV mode, timer TMR controls closing of SW4, as shown by pulses on curve (d). Each time SW4 is closed, a value of the deviation from P2 is detected, as shown by curve (c). The correction imposed to line 3' and line 20 appears in the form of a new value of the current I as per curve (a). Accordingly, the IV position is moved as shown by curve (e) back toward the P2 position, the general variation being similar as the variations of the current I along operative points C, D, E, F, G, . . . (at instants tc, td, te, tf, tg) thereby holding the level Imin, and the correlative position P2, from up, or from down, in the process.

Figure 4:
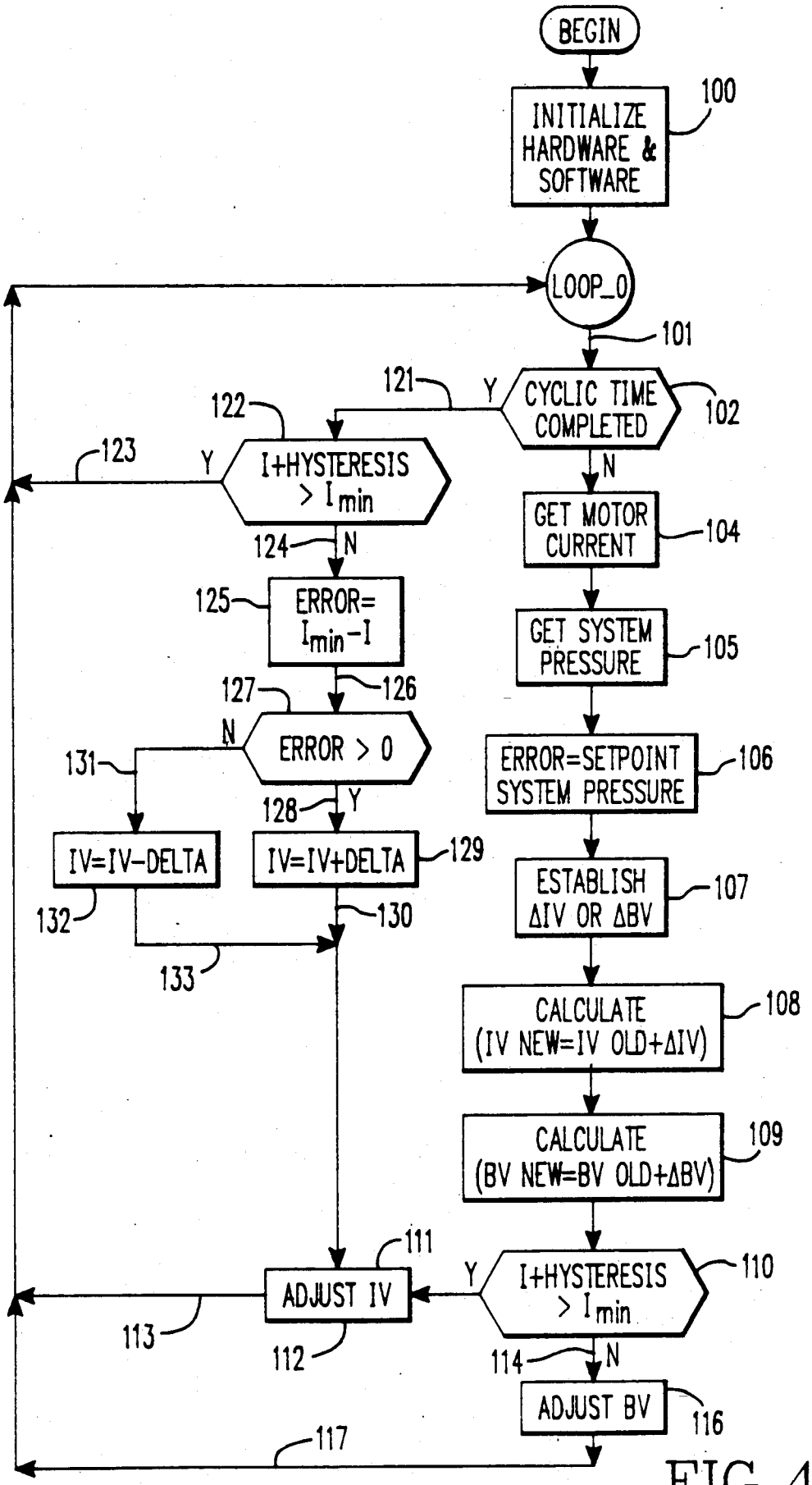
FIG. 4 is a flow chart illustrating the operation of the control system of FIG. 2.

FIG. 4 is a flow chart illustrating the operative steps under microprocessor control. At 100 the hardware and the software are initialized and control of the system is performed according to the following steps:

By line 101 the system goes first to 102 in order to ascertain whether the timer TMR of the subcontroller (SUB) is in the ON period of its cycle. If the answer is NO, by line 103 the system goes to 104 where the magnitude of the motor current is obtained. Then, at 105 the pressure feedback signal is obtained, the step being followed at 106 by calculating the error between the pressure setpoint and the derived pressure value. At 107 is established the corresponding correction for the valve being controlled, namely IV, or BV. If under IV modulation, at 108 is established the new IV valve position, using the old position plus the correction established at 107, namely: ($IVnew = IVold + \Delta IV$). If under BV modulation, at 109 is established the new BV valve position using the formula ($BVnew = BVold + \Delta BV$). Then, at 110 is determined whether the current I is larger than Imin. If YES, via line 111 the inlet valve is adjusted at 112 according to 108, and the system by line 113 returns to line 101 with the adjusted value. If there is a NO at 110, via line 114 the system goes to 116, where the bypass valve is adjusted according to 109, and the system, by line 117, returns to 101 with the adjusted value.

If, however, at 102 the conclusion is that the cycling process requires to look for an error if it exists, via line 121 the system goes to 122 where the question is whether: "I+hysteresis>Imin". If the answer is YES, by line 123 the system goes back to 101 and modulation of IV will be carried out according to blocks 104 to 108, as earlier stated. If the answer to 122 is NO, by line 124 the system goes to 125 where the error between Imin and I is established. By line 126 to block 127 is ascertained whether this error is positive (meaning whether the valve position is lower than position P2). If YES, by 128 the system goes to 129 where the valve position is incremented by an amount "delta". The corrected value is passed thereafter on line 130 to 112, namely to adjust IV accordingly, and by line 113 the system returns to 101. If NO at 127, by line 131 the system goes to 132 where a decrement delta is applied to the IV position and by line 133 the corrected value is passed to 112 for adjustment accordingly. This is followed, via line 133, by a return at 101.

A LISTING, illustrating the operative steps of the microprocessor according to the invention, follows in the APPENDIX starting with Page A1.

```
$title(Compressor Controller --> Adjust P2)
$eject xref debug

NAME  Adjust_p2

            ;ADJUST_P2      contains two subrutines.

            ;       P2_adjust is called from the 200ms loop.

            ;       inc p2adj_cntr
            ;       IF p2adj_cntr > cll_time
            ;          IF Iminflg SET (i.e. modulating bypass valve)
            ;             IF I_actual > CLL
            ;                x = x - cll_delta        (close IV to reduce I_actual)
            ;             ELSE
            ;                IF I_actual < CLL
            ;                   x = x + cll_delta     (open IV to increase I_actual)
            ;                ENDIF
            ;             ENDIF
            ;          ENDIF
            ;       ENDIF
            ;       RETURN


            ;       cll_offset is called from the 1 second loop

            ;       IF proportional band <= 10
            ;          Imin = (1.06) * CLL
            ;       ELSE
            ;          IF proportional band <= 25
            ;             Imin = (1.04) * CLL
            ;          ELSE
            ;             Imin = (1.02) * CLL
            ;          ENDIF
            ;       ENDIF
            ;       RETURN

current_lim_lo SEGMENT CODE     UNIT
     RSEG     current_lim_lo


     PUBLIC   cll_offset, p2_adjust


     EXTRN        BIT (iminflg)
```

```
EXTRN      CODE (comp2, double_multi, save_r23, save_r56, fetch_r01)
EXTRN      CODE (fetch_r23)

EXTRN      DATA (xl, xh)

EXTRN     XDATA (cll, iainl, iinstl, p2_adj_cntr, pbl, comp_ramp_flg)

inlet_delta     equ     1
cll_time equ    10      ;adjust p2 once each 2 seconds only
                        ; 200ms*10 = 2 seconds

gain_lo         equ     10
gain_med equ    25

pc_3lo          equ     08H
pc_3hi          equ     1

pc_2lo          equ     5
pc_2hi          equ     1


p2_adjust:
     mov     dptr, #p2_adj_cntr      ;point to this counter
     movx    a, @dptr                ;get it
     inc     a                       ;add one
     movx    @dptr, a                ;save it
     cjne    a, #cll_time, p2_ret    ;time to adjust p2 ?, NO ...
       clr   a                       ;ELSE ... reset counter
       movx @dptr, a
       jnb   iainflg, p2_ret         ;mod'ling bypass valve ?, NO ...
          mov  dptr, #iinstl         ;ELSE ... point to I_actual lo
          call fetch_r01             ;r1,0 = iinstl

      call fetch_cll                 ;r3,2 = cll

          mov  a, r2                 ;get CLL lo
          cjne a, 0, compare         ;I_actual lo = CLL lo ?, NO ...
          mov  a, r3                 ;ELSE ... get CLL hi
          cjne a, 1, compare         ;I_actual hi = CLL hi ?, NO ...
             ret                     ;ELSE ... I_actual = CLL

compare:        call comp2            ;c=1 if cll > I_actual
                jc  inc_inlet         ;I_actual > cll ?, NO ...
                  clr  c              ;ELSE ... clear this bit
                  mov  a, xl          ;get inlet DAC cll PI controller val lo
                  subb a, #inlet_delta ;subtract off this delta
                  mov  xl, a          ;save adjusted inlet DAC cll value lo

                  mov  a, xh          ;get inlet DAC cll PI controller val hi
                  subb a, #0          ;allow for a carry
                  mov  xh, a          ;save adjusted inlet DAC cll value hi
                  ret
inc_inlet:
                clr  c                ;clear this bit
                mov  a, xl            ;get inlet DAC cll PI controller val lo
                add  a, #inlet_delta  ;add this delta
                mov  xl, a            ;save adjusted inlet DAC cll value lo
                mov  a, xh            ;get inlet DAC cll PI controller val hi
                addc a, #0            ;allow for carry
                mov  xh, a            ;save adjusted inlet DAC cll value hi
```

```
test_limits:
      mov     a, xh                   ;get x value hi
      cjne    a, #3, lim_hi           ;hi byte = hi byte lim lo ?, NO ...
        mov   a, xl                   ;ELSE ... get lo byte
        cjne a, #0FFH, lim_lo         ;lo byte = lo byte lim lo ?, NO ...
          ret                         ;ELSE ... at lo limit (ok)
lim_lo:
        mov  xl, #0FFH                ;keep x at lo limit
        ret

lim_hi:
     cjne     a, #8, p2_ret           ;x value hi > x hi value limit ?, NO ...
        mov   xl, #0FFH               ;ELSE ... force x = hi value limit
        mov  xh, #7
p2_ret:
     ret
            ;* ********************
            ;calculate the current limit lo
            ;  offset value
            ;* ********************
cll_offset:
     mov      dptr, #comp_ramp_flg     ;point to this 'loading' flag
     movx     a, @dptr                 ;get it
     cjne     a, #0, cfc               ;finished step 1 ?, YES ...
    call fetch_cll                          ;ELSE ... r3,2 = operator selected CLL

       mov  dptr, #Imin1               ;point to controller psudo CLL lo
       call save_r23                   ;Imin = r3,2
    ret
cfc:
     mov      dptr, #pb1               ;point to proportional band lo
     call     fetch_r01                ;r1,0 = proportional band

     mov      r2, #gain_lo
     mov      r3, #0                   ;r3,2 = proportional band limit lo

     call     comp2                    ;c=1 if gain_lo > proportional band
     jnc      med_gain                 ;gain_lo > proportional band ?, NO ...
        mov   r1, #pc_3hi
        mov   r0, #pc_3lo              ;(r1,0 = 1.04 *256)   r1,0 = 1.03 *256
get_new_psudo:
    call fetch_cll

        call double_multi              ;r6,5 = n * CLL

        mov  dptr, #Imin1              ;point to controller psudo CLL lo
        call save_r56                  ;Imin = r6,5

cll_ret:   ret

med_gain:
     mov      r2, #gain_med
     mov      r3, #0                   ;r3,2 = proportional band limit med
```

```
        call    corp2                   ;c=1 if gain_red > proportional band
        jnc     hi_gain                 ;gain_red > proportional band ?, NO ...
           mov  r1, #pc_2hi
           mov  r0, #pc_2lo             ;(r1,0 = 1.04 *256)   r1,0 = 1.02 *256
           sjmp get_new_psudo

hi_gain:
        mov     r1, #pc_2hi
        mov     r0, #pc_2lo             ;r1,0 = 1.02 *256
        sjmp get_new_psudo

fetch_cll:
        mov   dptr, #cll                ;point to operator selected CLL lo
        call fetch_r23                  ;r3,2 = cll
        ret
END
```

I claim:

1. In a system for controlling a compressor, driven by a constant speed electrical motor, for admitting fluid into a tank under pressure therein, for use by a pressure responsive tool, including: an inlet valve for admitting fluid through the compressor, a bypass valve for relieving fluid pressure of said tank at an outlet thereof; a master-controller responsive to a signal representative of a tank pressure differential relative to a pressure setpoint signal representative of an assigned reference tank pressure, the master-controller being operative in relation to said tank pressure differential in one of two selected modes, for applying a valve positioning signal for modulating the inlet valve in a first of said modes and for modulating the bypass valve in a second of said modes; means being provided for deriving a signal representative of the motor operative current; and means being provided for comparing said motor current signal with a reference signal characterizing a minimum motor current corresponding to an assigned minimum compressor fluid flow for generating an error signal and for selecting one of said first and second modes according to the sign of said error signal; the combination of:

means for deriving an IV valve positioning signal representative of the IV valve present position;

a subcontroller means responsive to said error signal for generating a corrective signal and for applying said corrective signal to said IV valve positioning signal for modulating the IV valve;

said subcontroller means being enabled when the master-controller is in the second mode;

whereby said subcontroller means maintains said assigned minimum compressor fluid flow when the master-controller is operating in the second mode.

2. The system of claim 1 with said corrective signal being of a predetermined amount and being applied with a sign depending upon the sign of said error signal.

3. The system of claim 2 with said subcontroller means including timer means for applying said corrective signal cyclically.

* * * * *